US005590862A

United States Patent [19]

Ono

[11] Patent Number: 5,590,862

[45] Date of Patent: Jan. 7, 1997

[54] DEVICE FOR ADJUSTING THE LENGTH OF A SUPPORT

[76] Inventor: Tatsuo Ono, 5-20-13 Matsugaoka, Funabashi Chiba, Japan

[21] Appl. No.: 342,342

[22] Filed: Nov. 18, 1994

[30] Foreign Application Priority Data

Nov. 25, 1993 [JP] Japan ..... 5-318940

[51] Int. Cl.[6] ..... E04G 25/00

[52] U.S. Cl. ..... 248/354.1; 248/231.31; 248/297.31; 248/354.6; 248/412; 248/542

[58] Field of Search ..... 248/354.1, 354.4, 248/354.5, 354.6, 297.31, 228.2, 230.2, 231.31, 412, 414, 542

[56] References Cited

U.S. PATENT DOCUMENTS

| | | | |
|---|---|---|---|
| 2,747,828 | 5/1956 | Haarmann | 248/354.1 |

FOREIGN PATENT DOCUMENTS

| | | | |
|---|---|---|---|
| 508417 | 6/1953 | Belgium | 248/354.1 |
| 1101344 | 10/1955 | France | 248/354.1 |
| 1281995 | 12/1961 | France | 248/354.1 |
| 247236 | 5/1912 | Germany | 248/354.1 |
| 630073 | 5/1936 | Germany | 248/354.1 |
| 813539 | 9/1951 | Germany | 248/354.1 |
| 851490 | 10/1952 | Germany | 248/354.6 |
| 1113192 | 5/1960 | Germany | 248/354.1 |
| 294913 | 7/1928 | United Kingdom | 248/354.4 |

*Primary Examiner*—Ramon O. Ramirez
*Assistant Examiner*—Michael J. Turgeon
*Attorney, Agent, or Firm*—McGlew and Tuttle

[57] ABSTRACT

A device for adjusting the length of a support composed of an outer tube and an inner tube slidably inserted in the outer tube, includes an opening extending radially through the outer tube, a spacer radially movably received in the opening and confronted with an outer surface of the inner tube, a housing mounted on the outer tube in confronting relation to the opening, and a wedge slidably inserted in the housing to force the spacer radially inwardly against the inner tube. With this construction, the inner tube and the outer tube can be firmly fastened together with a great tightening force without damaging the inner tube. A stopper pivoted on the wedge and normally urged upward by a spring is able to preclude an unintended omission of driving the wedge or an incompletely driven or tightened condition of the wedge.

6 Claims, 5 Drawing Sheets

DEVICE FOR ADJUSTING THE LENGTH OF A SUPPORT

BACKGROUND OF THE INVENTION

1. Field of the Invention

The present invention relates to a device for adjusting the length of a support suitable for use as a main support or standard, a reinforcing horizontal member or brace or a reinforcing diagonal member or brace for a scaffold, or a main support or post or a reinforcing brace for timbering.

2. Description of the Prior Art

In a scaffold or a timber structure for building construction and civil engineering, there are used a number of vertical main supports and reinforcing horizontal and diagonal members interconnecting the main supports. More particularly, each adjacent pair of the main supports are interconnected by the so-called "support" or "brace" which is adjustable in length.

Lengthwise adjustable supports of this type are known as disclosed, for example, in Japanese Patent Laid-open Publication No. 58-123968 and Japanese Utility Model Publication No. 40-917.

The support disclosed in Japanese Utility Model Publication No. 40-917 includes, as reillustrated here in FIG. 5, an outer tube 1 and an inner tube 2 inserted in the outer tube 1 to constitute the support 3. The outer tube 1 has on its outer surface a housing 4 located at the front end of the outer tube 1 for guiding a wedge 5. The wedge 5 has teeth on its front inner surface and is slidably inserted in the housing 4.

While the wedge 5 is loosened, the inner tube 2 is moved into and out from the outer tube 1 to adjust the overall length of the support 3. When the wedge 5 is driven or forced into the housing 4 at a desired position, the inner tube 2 is locked in position against displacement so that a predetermined length of the support 3 is secured.

The disclosed conventional length adjusting device of the support is advantageous in that the length of the support 3 can be set only by driving the wedge 5. However, since the teeth on the front inner surface of the wedge 5 slide along an outer surface of the inner tube 2, the outer surface of the outer tube 1 is damaged by the teeth when the wedge 5 is driven into and out from the housing 4. With the outer surface thus damaged, the strength of the inner tube 2 may be reduced and the inner tube 2 is susceptible to rust.

In addition, since a tightening force produced by the wedge 5 acts on the inner tube 2 from a direction oblique to the axis of the inner tube 2, the tightening force in itself is relatively small and is incapable of keeping the inner tube in position against accidental slip when the inner tube is subjected to a severe tensile force X1 or a severe compressive force X2.

In particular, when the inner tube 2 is subjected to the compressive force X2 acting in a direction opposite to the driving direction of the wedge 5, the compressive force X acts as a force tending to remove the wedge 5 and hence the wedge 5 is liable to become loosened. Accordingly, the conventional length adjusting device cannot be effectively applied when the support is used in a site or place where the support is subjected to a tensile force X1 and a compressive force X2.

A further drawback is that due to a difficulty in confirming the driving or tightening condition of the wedge, the wedge is sometimes unintentionally left in a loose or untight condition and hence the support having the conventional length adjusting device is dangerous when used in a scaffold.

SUMMARY OF THE INVENTION

It is therefore a first object of the present invention is to provide a device for adjusting the length of a support, which is capable of tightening together an inner tube and an outer tube of the support with a minimum damage on the inner tube.

A second object of the present invention is to provide a length adjusting device of a support, which is capable of gripping an inner tube of the support with a great tightening force and is suitable for use with a support used in a site or place where the support is subjected to a tensile force and a compressive force.

A third object of the present invention is to provide a length adjusting device of a support, which is capable of preventing unintended omission of driving the wedge.

The first and second objects are accomplished in one embodiment by providing a device for adjusting the length of a support, which comprises: an outer tube and an inner tube slidably inserted in the outer tube to jointly form the support, the outer tube having an opening extending radially therethrough at a given position; a hollow housing mounted on the outer tube in confronting relation to the opening; a spacer radially movably received in the opening and confronted with an outer surface of the inner tube; and a wedge movably inserted in the housing and confronted with the spacer.

To accomplish the third object, the wedge has a recessed portion on its outer surface, a stopper pivotally mounted in the recessed portion via a pin for confirming a tightened condition of the wedge, and a spring acting between an outer surface of the recessed portion and the stopper for urging an end of the stopper upwardly. Preferably, the spacer has on its under surface at least one tooth engageable in point—contact or in linear—contact with the outer surface of the inner tube.

It is preferable that the inner tube includes a connecting plate attached to an inner end thereof and having an oblong hole extending longitudinally of the connecting plate, and the outer tube includes a connecting rod extending diametrically through the outer tube via the oblong hole.

The first and second objects is also accomplished in another embodiment by providing a device for adjusting the length of a support, which comprises: an outer tube and an inner tube slidably inserted in the outer tube to jointly form the support, the outer tube having a pair of diametrically opposed first and second openings extending radially therethrough at a given position; a first hollow housing and a second hollow housing mounted on the outer tube in confronting relation to the first and second openings, respectively; a first spacer and a second spacer radially movably received in the first and second openings, respectively, and confronted with an outer surface of the inner tube; and a first wedge and a second wedge movably inserted in the first and second housings, respectively, and confronted with the first and second spacers, respectively.

According to one preferred form, respective inner surfaces of the first and second housings or respective outer surfaces of the first and second spacers have tapered surfaces tapering off in the same direction, and the first and second wedges are adapted to be inserted from the same direction.

According to another preferred form, respective inner surfaces of the first and second housings or respective outer surfaces of the first and second spacers have tapered surfaces tapering off in opposite directions, and the first and second wedges are adapted to be inserted from opposite directions.

With this construction, the inner tube is slid outwardly or inwardly relative to the outer tube to temporarily set a total length of the outer tubes and inner tubes. While keeping this condition, the wedge is driven whereupon the spacer is forced radially inwardly at right angles to the direction of movement of the wedge and moves into locking engagement with the outer surface of the inner tube. Thus, the inner tube is firmly gripped between the spacer and the inner surface of the outer tube against removal, thereby securing the temporarily set total length.

Since the inner tube is forced by the spacer at right angles to the axis of the inner tube and hence an extremely great tightening force is exerted on the inner tube. In addition, the inner surface of the spacer does not rub off on the outer surface of the inner tube so that the outer surface of the inner tube is free from damage.

Since the stopper used for confirming the tightening condition is urged upwardly, it is possible to confirm from the outside that the wedge is unstably tightened unless the stopper is inserted in the housing against the force of the spring.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION OF THE PREFERRED EMBODIMENTS

Figure 1:
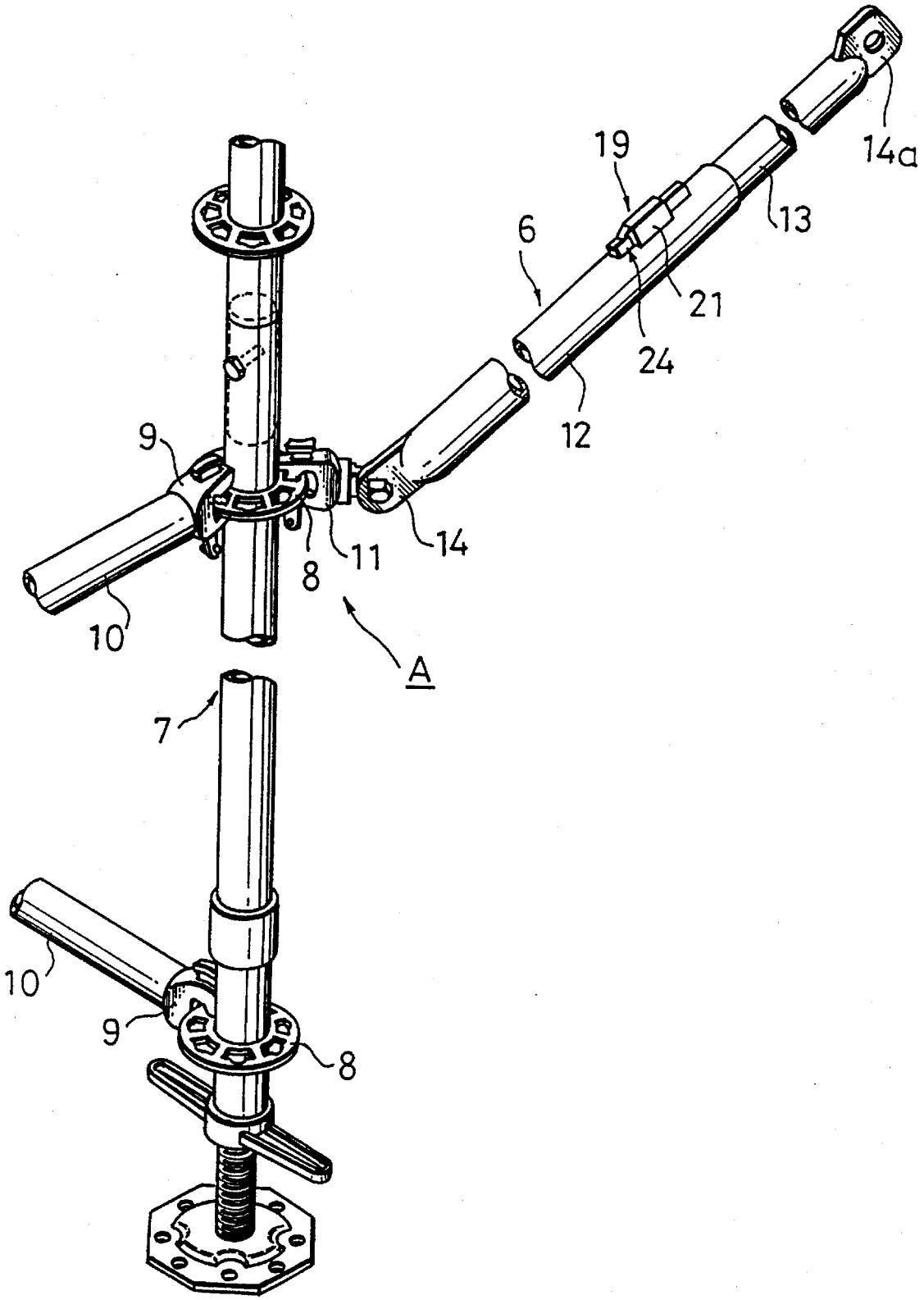
FIG. 1 is a perspective view of a portion of a scaffold in which a support according to an embodiment of the present invention is used.
Figure 2:
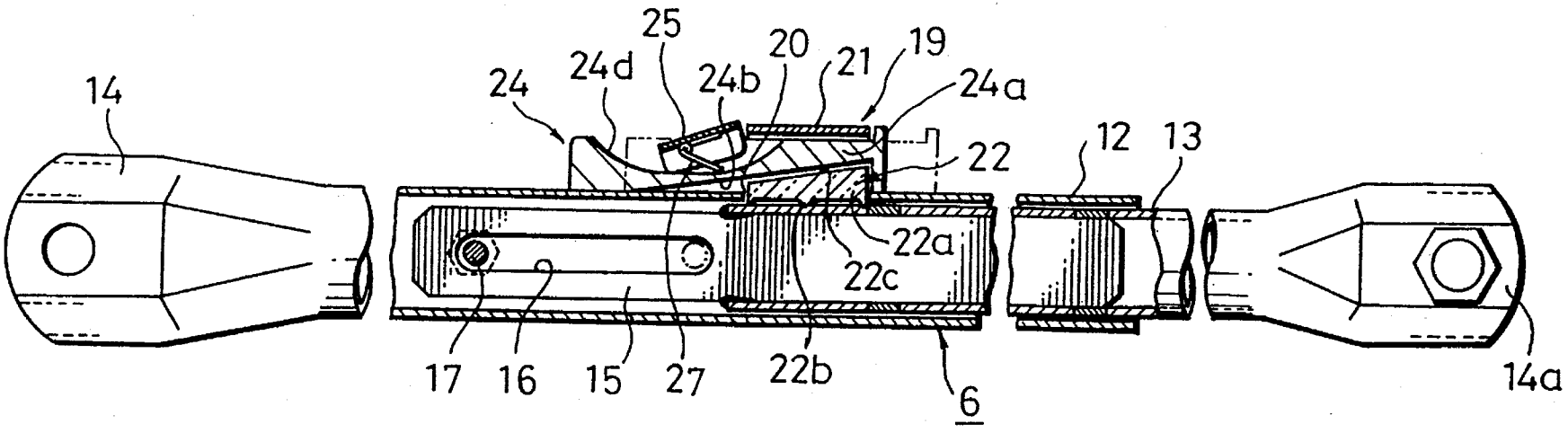
FIG. 2 is a longitudinal cross-sectional view of the support shown in FIG. 1.
Figure 3:
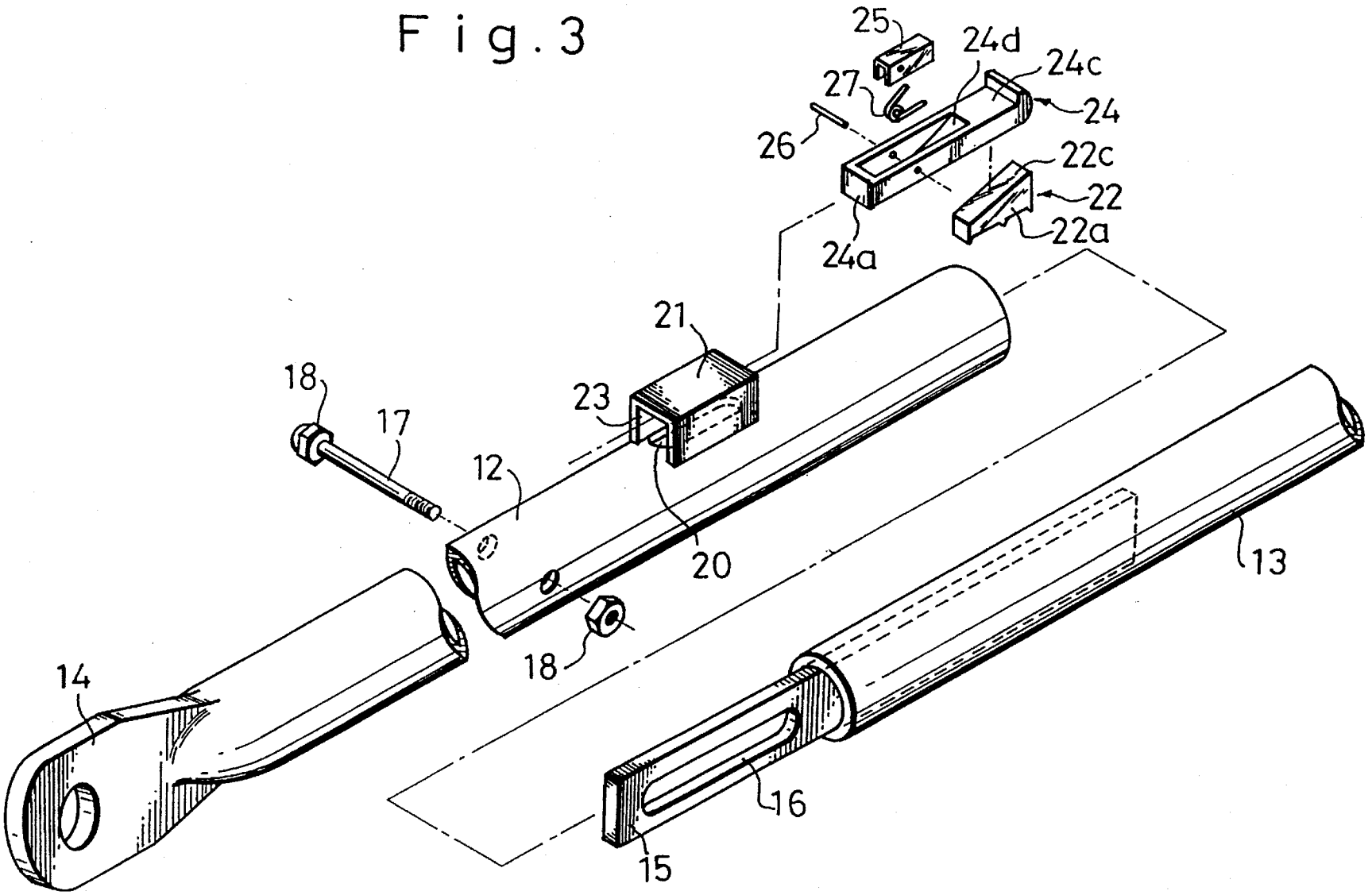
FIG. 3 is an exploded perspective view of the support shown in FIG. 2.

FIGS. 1 through 3 illustrate a support and a length adjusting device associated therewith according to an embodiment of the present invention.

The support 6 is used as a horizontal member or a diagonal member of a prefabricated scaffold or a timber structure A for building construction and civil engineering.

The prefabricated scaffold A is composed of a number of vertical main supports or standards 7 and horizontal members 10 each extending horizontally in a given direction joined with two adjacent ones of the standards 7 via a pair of flanges 8 (one being shown) and a pair of shoes 9 (one being shown). The two adjacent pair of the standards 7 are further joined together by a diagonal member or support 6. The support 6 thus connected reinforces the standards 7 and the horizontal members 10.

The support 6 is joined with the adjacent standards 7 and 7 via a pair of flanges 8 (one being shown) and a pair of shoes 11 (one being shown). The length of the support 6 is adjusted to confirm to the width between the adjacent standards 7, 7.

The support 6, as shown in FIGS. 2 and 3, is composed of a circular cylindrical outer tube 12 and an inner tube 13 slidably inserted in the outer tube 12. The outer tube 12 has at its one end an integral bracket 14 adapted to be pivotally connected to one of the pair of shoes 11. Similarly, the inner tube 13 has at its outer end an integral bracket **14*a* adapted to be pivotally joined with the other shoe 11**.

The inner tube 13 has an inner end which is attached by welding, for example, to an elongated connecting plate 15. The connecting plate 15 has an oblong hole 16 extending centrally along a longitudinal axis of the connecting plate 15. The connecting plate 15 may be connected directly to the inner end of the inner tube 13, or alternatively it may have an end fitted deeply in the inner end portion of the inner tube 13, as shown in FIG. 2 and 3, so as to reinforce the inner tube 13.

A connecting rod 17 serving as a support shaft extends diametrically through the outer tube 12 at a position adjacent to the one end or the bracket 14. The connecting rod 17 also extends through the oblong hole 16 in the connecting plate 15. A pair of nuts 18 is threaded over opposite ends of the connecting rod 17 to securely fasten the outer tube 12 and the inner tube 13.

Thus, the inner tube 13 is coupled with the outer tube 12 via the oblong hole 16 and the connecting rod 17 such that the inner tube 13 is movable in the axial direction relative to the outer tube 12 within the length of the oblong hole 16 or within a distance defined between the solid-lined position of the connecting rod 17 and the phantom- lined position of the connecting rod 17. A total or combined length of the outer tube 12 and the inner tube 13 can, therefore, be adjusted in proportion to the distance or extent of relative movement between the inner and outer tubes 13, 12.

The overall length of the support 6 is retained by a length adjusting device 19 described below.

The length adjusting device 19 generally comprises an opening 20 extending radially through the outer tube 12 at a given position of a body of the outer tube 12, a hollow housing 21 mounted on an outer surface of the outer tube 12 in confronting relation of the opening 20, a spacer 22 radially movably received in the opening 20 and confronted with an outer surface of the inner tube 13, and a wedge 24 movably inserted in a space 23 defined in the housing 21 along the axial direction of the housing 21, the wedge 24 being movable in the axial direction of the support 6.

The housing 21 and the opening 20 in the illustrated embodiment extend in the axial direction of the outer tube 12. They may extend in the circumferential direction of the outer tube 12 in which instance the wedge 24 is movable in a tangential direction of the outer tube 12. As a further alternative, the outer tube 12 may have an end extension projecting continuously from the other end of the outer tube 12, and the housing 21 is mounted on the end extension. In this instance, the opening 20 is formed in the end extension of the outer tube 12.

The spacer 22 includes an elongated body **22*a* having on its under surface one or more teeth 22*b* and, an upper surface shaped to provide a taper surface 22*c*. The teeth 22*b* are normally held in engagement with the outer surface of the inner tube 13**.

The teeth **22*b* may be composed of a plurality of sharp or pointed projections or a plurality of rigs having a triangular cross section. In any case, it is desirable that the teeth 22*b* are engageable in point-contact or in linear-contact with the outer surface of the inner tube 13**.

The under surface of the body 22*a* of the spacer 22 is preferably curved to conform to the shape of the outer surface of the inner tube 13.

The teeth 22*b* may be composed of a combination of one or more teeth so profiled as to secure the point-contact with the inner tube 13 and one or more teeth so profiled as to secure the linear-contact with the inner tube 13.

The wedge 24 includes an elongated body 24*a* having a wedge recessed portion with a taper surface 24*b* formed on the under surface of the body 24*a* for sliding engagement with the taper surface 22*c* of the spacer 22, a horizontal surface 24*c* formed on an outer surface of the body 24*a* adjacent to a front end thereof for sliding engagement with an inner peripheral surface of the housing 19, and a recessed stopper portion 24*d* formed in the outer surface of the body 24*a* adjacent to the rear end thereof for a purpose described later.

The recessed portion 24*d* receives therein a stopper 25 having a U-shaped cross section. The stopper 25 is pivotally connected by a pivot pin 26 to the wedge 24, with a spring 27 acting between an outer surface of the recessed stopper portion 24*d* and the stopper 25 to urge a one or the front end of the stopper 25 upwardly.

The stopper 25 is used as an indicator which enables visual confirmation of the tightening condition of the wedge 24. As an alternative, the indicator may be composed of a mark or a line provided on the upper surface or a side surface of the body 24*a* of the wedge 24.

Now, operation to be achieved to adjust the length of the support 6 will be described below.

FIG. 2 shows a condition in which the wedge 24 is not driven or tightened. In this condition, the spacer 22 is not subjected to an external force, so that the inner tube 13 is displaceable inwardly and outwardly relative to the outer tube 12 until a desired length of the support 6 is determined.

When the inner tube 13 is slidably moved to a position for setting the desired length, the wedge 24 is forced or driven in a direction toward the bracket 14*a* shown in FIG. 2. With this movement of the wedge 24, the taper surface 24*b* of the wedge 24 is brought into sliding engagement with the upper taper surface 22*c* of the spacer 22 whereupon the movement of the wedge 24 in the axial direction of the inner tube 13 is translated into a movement of the spacer 22 in a radially inward direction normal to the axis of the inner tube 13.

Thus, the teeth 22*b* on the spacer 22 are forced against the outer surface of the inner tube 13.

Consequently, the inner tube 13 is firmly gripped via the teeth 22*b* between the spacer 22 and an inner peripheral surface of the outer tube 12 against axial displacement relative to outer tube 12. Thus, the desired length of the support 6 is secured. To drive-in the wedge 24, the operator inserts the stopper 25 into the housing 21 together with the wedge 24 while depressing with its finger the front end of the stopper 25 against the force of the spring 27. Accordingly, when the stopper 25 is inserted in the housing 21, it can be confirmed that the wedge 24 is completely driven. In contract, so long as the stopper 25 is exposed from the housing 21, an unintentional omission of driving the wedge 24 or an incomplete driving or tightening condition of the wedge 24 can be visually confirmed.

When the wedge 24 is driven or hit in the opposite direction, the wedge 24 is loosened whereupon the spacer 22 is released from the external force, i.e., the tightening force. Now, the inner tube 13 is placed again in a condition slidably movable relative to the outer tube 12.

Figure 4:
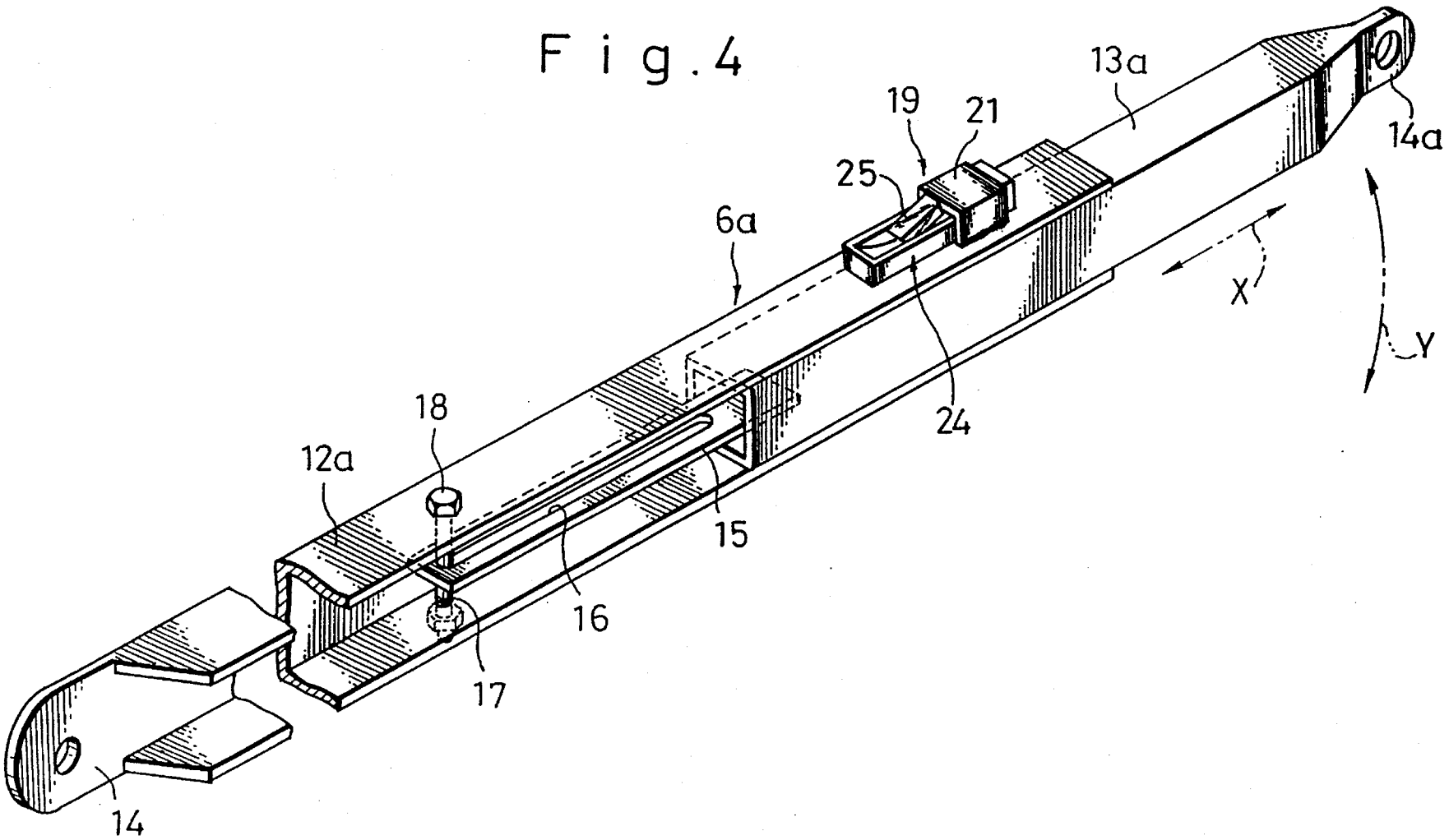
FIG. 4 is a perspective view of a support according to another embodiment of the present invention.
Figure 5:
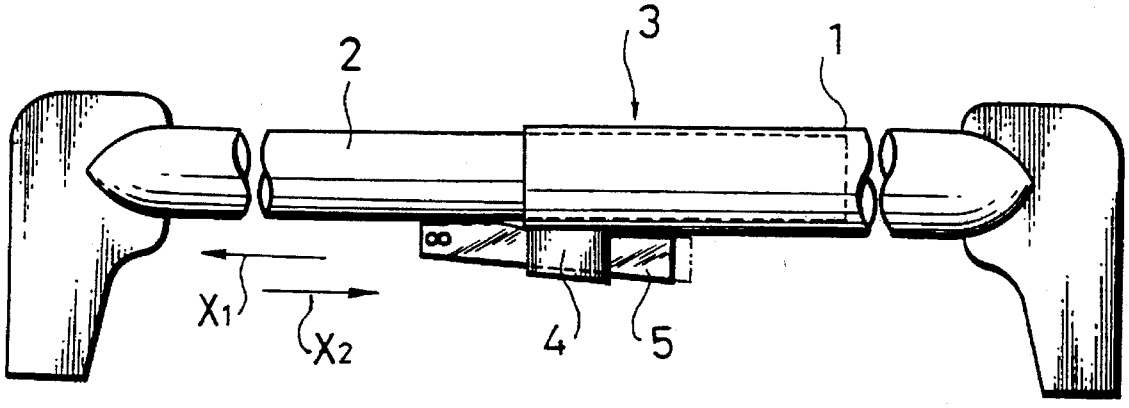
Fig.5 (PRIOR ART)
FIG. 5 is a front elevational view of a conventional support.

FIG. 4 shows a modified form of the support according to another embodiment of the present invention. The structure, operation and effects of the modified support 6*a* are substantially the same as those described in connection with FIG. 2.

The support 6*a* is composed of an outer tube 12*a* having a substantially U-shaped cross-section, and an inner tube 13*a* having a square cross section and slidably inserted in the U-shaped outer tube 12*a*. Other structural and operational details of the support 6*a* are the same as those of the support 6 shown in FIG. 2. Therefore, the corresponding parts are designated by the same reference characters, and a detailed description thereof will be omitted.

The support 6*a* shown in FIG. 4 is slidably movable in the axial direction as indicated by the arrow X and also is pivotally movable about a connecting rod 17 in a direction indicated by the arrow Y. With this pivoted arrangement, the inner tube 13*a* can readily be displaced to the outside of the outer tube 12*a* where repair and replacement of the inner tube 13*a* can be achieved with utmost ease.

1) According to the above structure when the wedge is driven, the spacer is forced radially inwardly (at right angles to the axis of the inner tube) into pressure contact with the inner tube. Thus, the inner tube can be firmly locked in position against displacement relative to the outer tube without involving an undesired phenomenon such as galling or slip between the inner tube and the spacer. The inner tube is, therefore, free from damage and is fully protected against a problem, such as a reduction in the mechanical strength, and production of rust. Furthermore, since a tightening force produced by the wedge acts via the spacer on the inner tube in a direction perpendicular to the axis of the inner tube, the inner tube is securely fastened to the outer tube with a great tightening force.

2) By virtue of the stopper an unintended omission of driving the wedge can be avoided.

3) The at least one tooth formed on the spacer is able to firmly retain the inner tube in position against displacement via a point-contact or a linear-contact formed between the tooth and the outer surface of the inner tube.

4) Owing to a pin-and-hole connection formed between the connecting rod and an oblong hole formed in the connecting plate, the inner tube and the outer tube are joined together without accidental separation while permitting adjustment of the total or combined length of the inner and outer tubes within the length of the oblong hole.

Obviously, various minor changes and modifications of the present invention are possible in the light of the above teaching. It is therefore to be understood that within the scope of the appended claims the invention may be practiced otherwise than as specifically described.

What is claimed is:

1. A device for adjusting the length of a support, comprising:

an outer tube and an inner tube slidable inserted in said outer tube to jointly form the support, said outer tube having an opening extending radially therethrough at a given position;

a hollow housing mounted on said outer tube in confronting relation to said opening;

a spacer radially movably received in said opening and confronted with an outer surface of said inner tube, said spacer including an elongated spacer body with a toothed surface contactable with said outer surface of said inner tube, said elongated spacer body having a taper surface on a diametrically opposite side of said elongated spacer body from said toothed surface; and a wedge movably inserted in said housing and confronted with said spacer, said wedge including an elongated wedge body defining a recessed wedge portion formed on a first side of said wedge, said recessed wedge portion being receivable of said spacer, said wedge also including a taper surface formed on a section of said recessed wedge portion for sliding engagement with said taper surface of said spacer.

2. A device according to claim 1, wherein said wedge defines a recessed stopper portion, a stopper pivotally mounted in said recessed stopper portion via a pin for confirming a tightened condition of said wedge, and a spring acting between a surface of said recessed stopper portion and said stopper for biasing an end of said stopper upwardly.

3. A device according to claim 1, wherein a tooth of said toothed surface is engageable in one of a point-contact or in linear-contact manner with said inner tube.

4. A device according to claim 1, wherein said inner tube includes a connecting plate attached to an inner end thereof and having an oblong hole extending longitudinally of said connecting plate, and said outer tube includes a connecting rod extending diametrically through said outer tube via said oblong hole.

5. A device for adjusting the length of a support, the device comprising:

an outer tube defining an opening extending radially through said outer tube;

an inner tube slidable insertable into said outer tube to jointly form the support with said outer tube;

a hollow housing mounted on said outer tube in confronting relation to said opening;

a spacer radially movable in said opening and contactable with an outer surface of said inner tube;

a wedge movably positioned in said housing and contactable with said spacer, said wedge defining a recessed stopper portion;

a stopper pivotably mounted in said recessed stopper portion via a pin for confirming a tightened condition of said wedge;

a spring acting between a surface of said recessed stopper portion and said stopper for biasing an end of said stopper outwardly.

6. A device for adjusting the length of a support, comprising:

an outer tube and an inner tube slidable inserted in said outer tube to jointly form the support, said outer tube having an opening extending radially therethrough at a given position;

a hollow housing mounted on said outer tube in confronting relation to said opening;

a spacer radially movably received in said opening and confronted with an outer surface of said inner tube, said spacer including an elongated spacer body with a toothed surface contactable with said outer surface of said inner tube, said elongated spacer body having a taper surface on a diametrically opposite side of said elongated spacer body from said toothed surface; and a wedge movably inserted in said housing and confronted with said spacer, said wedge including an elongated wedge body defining a recessed wedge portion formed on a first side of said wedge, said recessed wedge portion being receivable of said spacer, said wedge also including a taper surface formed on a section of said recessed wedge portion for sliding engagement with said taper surface of said spacer, said wedge defining a recessed stopper portion, a stopper pivotally mounted in said recessed stopper portion via a pin for confirming a tightened condition of said wedge, and a spring acting between a surface of said recessed stopper portion and said stopper for biasing an end of said stopper upwardly.

* * * * *